US006477861B1

(12) United States Patent
Pottick

(10) Patent No.: US 6,477,861 B1
(45) Date of Patent: Nov. 12, 2002

(54) BEADED ORNAMENT AND ARRANGEMENT FOR AND METHOD OF MAKING SAME

(76) Inventor: Daniel J. Pottick, 11 Country Club Way, Demarest, NJ (US) 07627

( * ) Notice: Subject to any disclaimer, the term of this patent is extended or adjusted under 35 U.S.C. 154(b) by 0 days.

(21) Appl. No.: 09/934,953

(22) Filed: Aug. 22, 2001

(51) Int. Cl.[7] ..... A44G 5/00; A44C 5/00

(52) U.S. Cl. ..... 63/3; 63/1.11; 63/3.2; 63/38; 29/896.4; 29/896.411; 59/80

(58) Field of Search ..... 63/1.11, 1.16, 63/3, 3.1, 3.2, 30, 33, 38–40; 29/896.41, 896.411, 896.4; 59/80, 83

(56) References Cited

U.S. PATENT DOCUMENTS 3,667,098 A * 6/1972 Levy ..... 29/896.41
3,733,852 A * 5/1973 Johnson et al. ..... 24/356
5,114,377 A * 5/1992 Cove Mercuri et al. ..... 428/12
5,230,631 A * 7/1993 Halmaghi et al. ..... 434/284
5,590,546 A * 1/1997 Hector ..... 63/38
5,946,728 A * 9/1999 Tane ..... 132/273
5,966,811 A * 10/1999 Zalusky ..... 140/124
6,378,334 B1 * 4/2002 Hector ..... 63/26

* cited by examiner

*Primary Examiner*—Robert J. Sandy
*Assistant Examiner*—Andre L. Jackson
(74) *Attorney, Agent, or Firm*—Kirschstein, et al.

(57) ABSTRACT

An ornament such as a bracelet, necklace or like jewelry is made by turning one bight end portion of a closed loop on which beads have been threaded relative to an opposite bight end portion. The beads are held in a fixed relation by twisted rail portions of the loop.

17 Claims, 4 Drawing Sheets

A

BEADED ORNAMENT AND ARRANGEMENT FOR AND METHOD OF MAKING SAME

BACKGROUND OF THE INVENTION

1. Field of the Invention

The present invention generally relates to a beaded ornament and an arrangement for, and a method of, making the ornament and, more particularly, to jewelry worn on a human body for decoration, such as necklaces, bracelets, earrings and rings, and, still more particularly, to a craft kit for enabling a craftsperson, especially a child, to make such jewelry.

2. Description of the Related Art

Jewelry-making craft kits utilizing beads of various sizes, colors and shapes and suitable for use by all ages and levels of skill of craftspeople are generally known. A typical kit includes a flexible element, such as a string or yarn, which is threaded through a hole extending through each bead. To prevent the beads from moving along the flexible element, it is known to tie one or more knots in the element, each knot being larger in size than a respective bead hole. As advantageous as such kits are in making jewelry, especially for wear by children, experience has shown that the flexible element may break, especially with rough handling, and that the beads tend to move along the flexible element despite the presence of the knots.

SUMMARY OF THE INVENTION

OBJECTS OF THE INVENTION

Accordingly, it is a general object of this invention to provide a craft kit whereby young and old alike can create a decorative, finished item of jewelry, without the necessity of extensive training or particular artistic skills.

More particularly, it is an object of the present invention to create a beaded ornament wherein the beads will not undesirably move along a mounting element, and wherein the mounting element is resistant to breaking.

Still another object of the present invention is to provide a novel arrangement for, and a novel method of, making a jewelry item, which is easy and entertaining to make, requires little time to complete, is aesthetic in appearance, and is durable in use.

FEATURES OF THE INVENTION

In keeping with the above objects and others which will become apparent hereinafter, one feature of the present invention resides, briefly stated, in an arrangement for, and a method of, making an ornament, especially jewelry worn by a child, by employing a supporting structure having a pair of supports spaced apart along a longitudinal axis. A closed loop of a twistable material, such as a metal wire which is resistant to breaking but retains its shape after being distorted, has a pair of bight end portions respectively mounted on the supports, and a pair of rail portions extending along the longitudinal axis between the supports. A plurality of beads is successively arranged along the rail portions. The beads may be of the same or different colors, sizes, shapes and compositions. Each bead has a passage through which both rail portions are threaded with clearance.

In accordance with this invention, an actuator, for example, a manually turnable hand crank, is operative for jointly turning one of the supports and the bight end portion mounted thereon in a circumferential direction about the longitudinal axis. During this turning, the rail portions are twisted about each other and form twists in successive arrangement along the rail portions. Each twist adjacent a bead tends to hold the bead in a fixed relation on the rail portions. Due to the nature of the material used for the loop, each twist does not untwist, but instead, retains its twisted shape, thus insuring that the beads will not undesirably slide along the loop.

Preferably, the supporting structure includes a main housing section, and an extension section mounted on the main section for movement along the longitudinal axis. The beads are stored in compartments in the main section. Indicia, indicating the length of the loop, is provided on the main and the extension sections. A plurality of locks is successively arranged along the housing sections for locking them in a selected position relative to each other.

After the beads have been fixed in position, the closed loop is removed from the supports and formed into an annulus when it is desired to form the ornament as a bracelet, necklace, or ring. A fastener, for example, a resilient latch, may be mounted on one of the bight end portions and is then hooked onto the other bight end portion to make it convenient to wear or remove a bracelet or necklace from one's wrist or neck, respectively. The bight end portions can also be directly connected to each other.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 11:
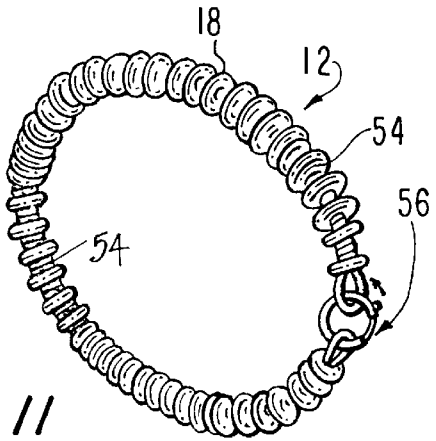
FIG. 11 is a perspective view of a finished bracelet made in accordance with this invention.

Referring now to the drawings, reference numeral 10 generally identifies an arrangement for making an ornament 12 (see FIG. 11). The ornament may be an item of jewelry such as a bracelet, necklace, earring, or ring, or any decoration including one not worn by a person. It is particularly intended for the ornament to be made and worn by a child, thereby enabling the arrangement to serve as a craft kit.

Figures 2, 3, 4:
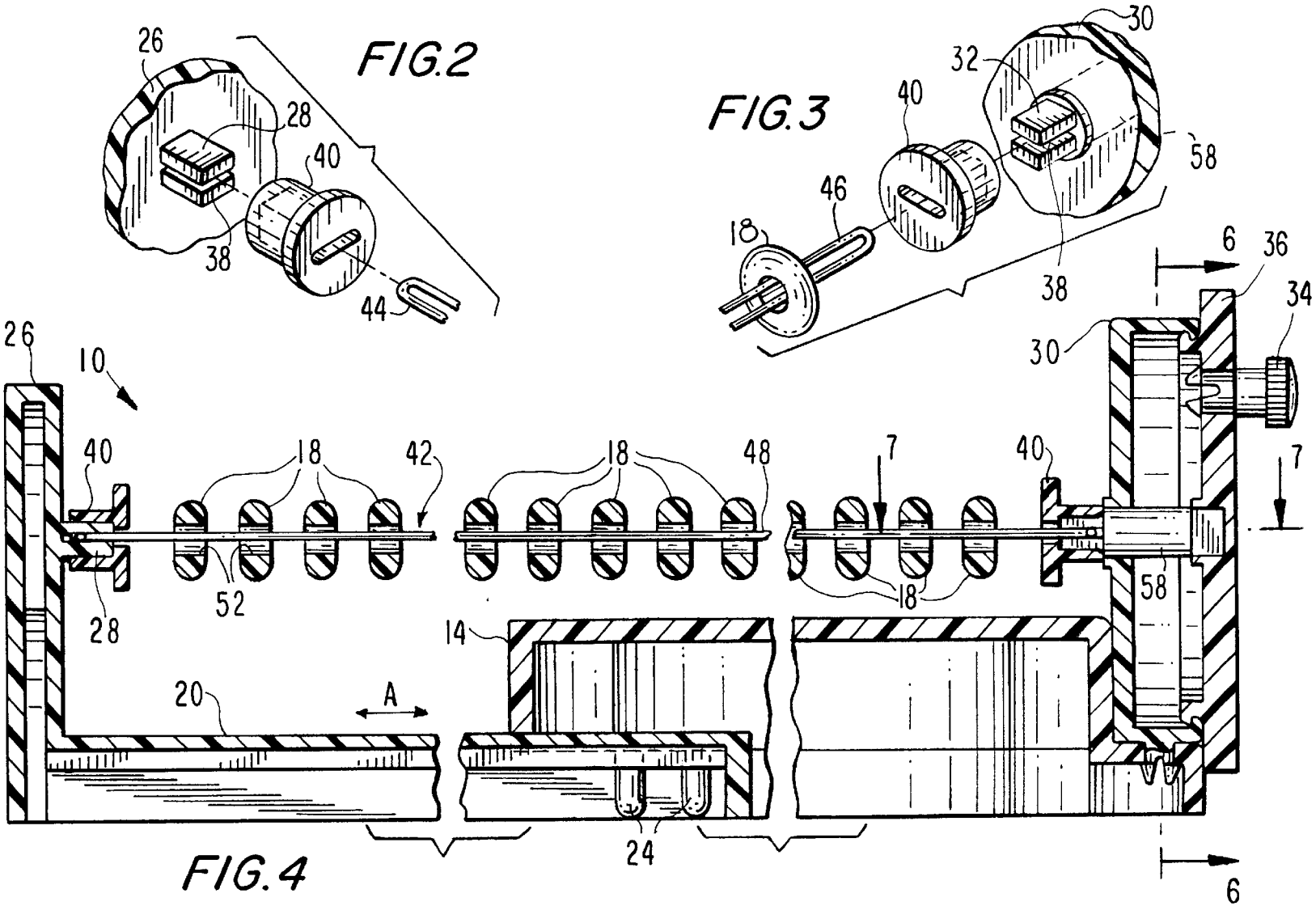
FIGS. 2 and 3 are exploded, enlarged, perspective views of the mounting of opposite bight portions of a closed loop on opposite supports of the arrangement of FIG. 1.
FIG. 4 is a sectional view taken on line 4—4 of FIG. 1.
Figure 5:
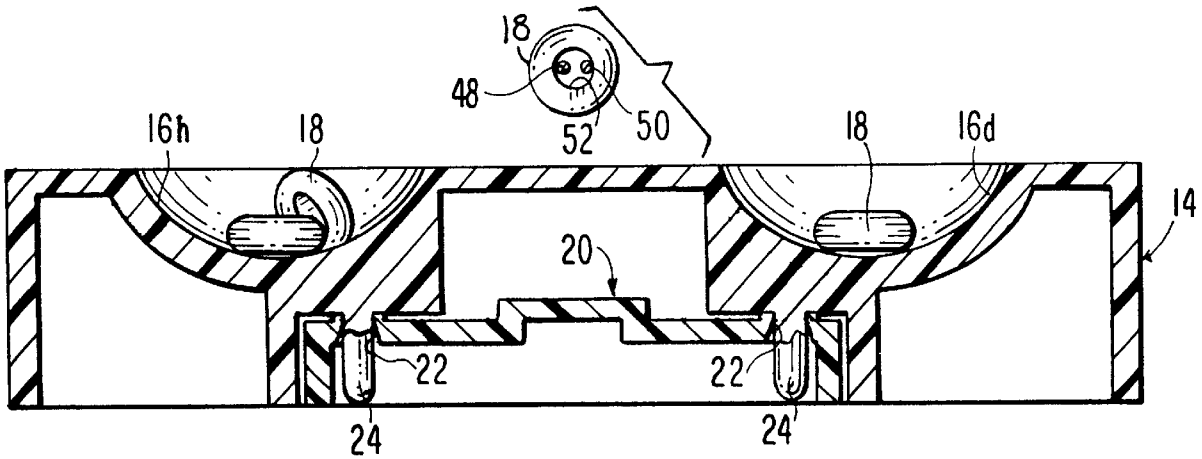
FIG. 5 is a sectional view taken on line 5—5 of FIG. 1.
Figure 6:
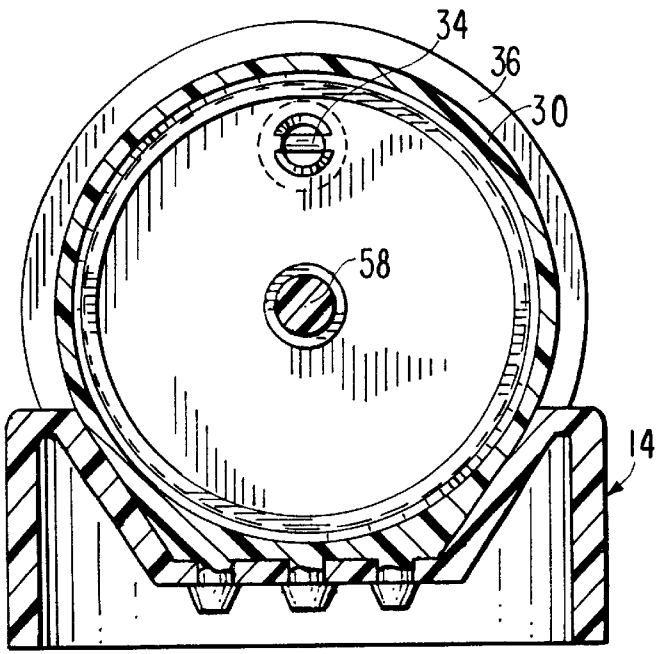
FIG. 6 is a sectional view taken on line 6—6 of FIG. 4.
Figure 8:
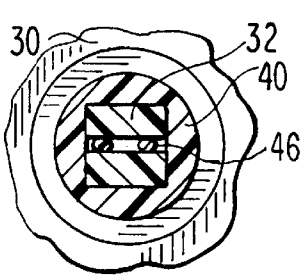
FIG. 8 is a sectional view taken on line 8—8 of FIG. 7.

Arrangement 10 includes a main housing section 14 having a plurality of bead storage compartments 16*a–h* for storing a corresponding plurality of beads 18, preferably of different shapes, colors, sizes and compositions, and an extension housing section 20 mounted for movement along a longitudinal axis identified by the double-headed arrow A toward and away from the main section 14. Extension section 20 has a plurality of holes 22 arranged along two rows parallel to the longitudinal axis. Main section 14 has a corresponding plurality of pegs 24 (see FIGS. 4 and 5), also arranged along two rows parallel to the longitudinal axis.

A scale 26 having markings, preferably in quarter-inch increments, is provided on an upper central surface of the main section 14, and is continued on an upper central surface of the extension section 20. The scale is a visual indicator of how far or how close the housing sections are positioned relative to one another. Once a selected position is chosen, the pegs 24 on the main section are positioned in the corresponding holes 22 of the extension section, thereby locking the housing sections together in the selected position. Once locked together, the housing sections due to their coplanar flat lower surfaces rest on a work surface, such as a tabletop.

A stationary end part 26 extends upwardly from an end region of the extension section. A stationary support 28 (see FIG. 2) is fixedly secured to the part 26. Another stationary end part 30 is mounted on, and extends upwardly from, an end region of the main section. A turnable support 32 (see FIG. 3) is mounted on the part 30 for turning movement. More particularly, a hand crank 34 is fixedly secured to a turnable disc 36 which is journalled in the part 30. The support 32 is fixed by a longitudinal stub shaft 58 to the turnable disc 36, and is turned when the crank 34 is turned.

Each support 28, 32 has two half-cylindrical arms bounding a slot 38 therebetween. As described below, the arms are normally positioned apart, but are forcefully urged toward one another when a respective clamp 40 is forced over the arms.

Figure 7:
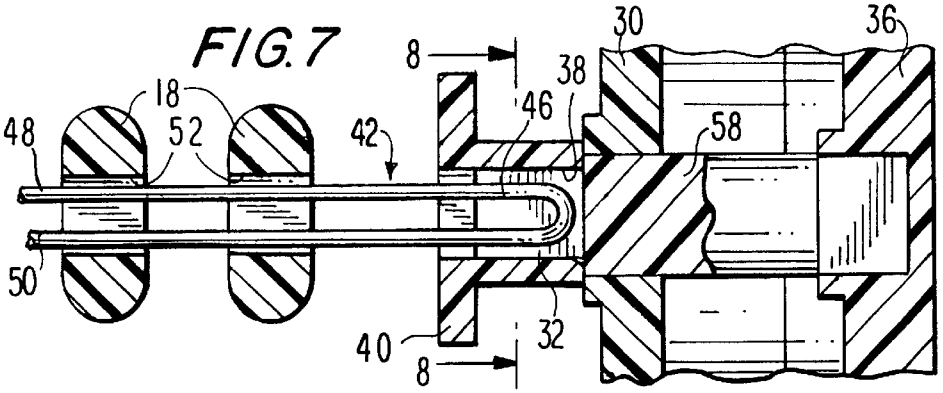
FIG. 7 is a sectional view taken on line 7—7 of FIG. 4.

A closed loop 42 (see FIGS. 1 and 7), preferably constituted of a metal wire, is mounted on, and between, the supports 28, 32. The loop 42 is formed as an elongated oval, and has a pair of bight end portions 44, 46 (see FIGS. 2 and 3) respectively mounted in the slots 38 of the supports 28, 32, and a pair of rail portions 48, 50 extending generally along the longitudinal axis in mutual parallelism between the bight end portions.

Each of the beads 18 has a passage 52 (see FIGS. 5 and 7) through which both rail portions 48, 50 are threaded with clearance. An operator selects the beads in any desired pattern and threads them onto the rail portions. Once all the selected beads are successively arranged along the rail portions, the clamps 40 are threaded onto the opposite ends of the loop. Thereupon, bight end portion 44 is positioned in slot 38, and one of the clamps 40 is slid onto the support 28 to press the arms into clamping engagement with the bight end portion 44. Similarly, bight end portion 46 is positioned in the other slot 38, and the other clamp 40 is slid onto the support 32 to press the arms into clamping engagement with the bight end portion 46 (see FIG. 7). The closed loop with the beads thereon is suspended with a little slack between the supports 28, 32.

Figure 9:
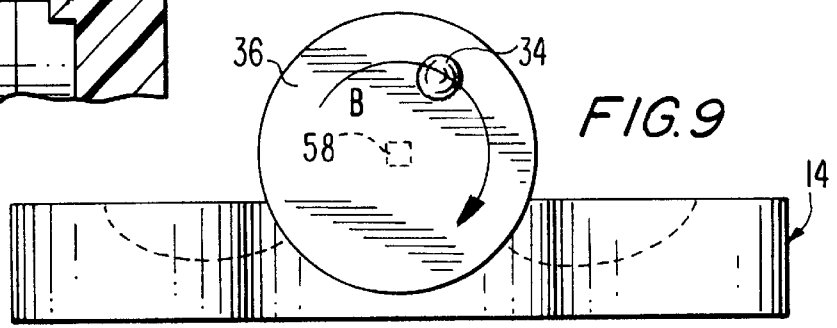
FIG. 9 is an end elevational view showing the turning of a hand crank of the arrangement of FIG. 1.
Figure 10:
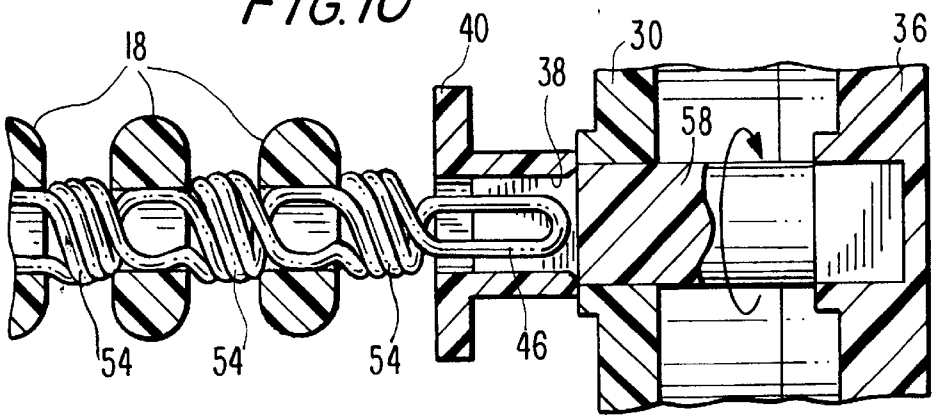
FIG. 10 is an enlarged sectional view of a portion of the arrangement depicted in FIG. 4 during the twisting of the loop.

The operator next turns the crank 34 in a circumferential direction about the longitudinal axis in the direction of arrow B in FIG. 9, thereby turning the stub shaft 58, the support 32 and the bight end portion 46 mounted thereon. The other bight end portion 44 is held stationary by the stationary support 28. The turning of the crank causes the rail portions to twist about one another and, of course, the more turns, the more twists 54 that are formed in succession along the rail portions, as shown in FIG. 10.

Once formed, the twists 54 do not untwist due to the nature of the metal wire which is readily twisted without breaking, and which retains its twisted shape once the twisting force is discontinued. A twist adjacent a bead prevents the bead from undesirably moving past the twist. A succession of twists anchors all the beads in place.

Next, the beaded loop, with the beads anchored by the twists, is removed from the supports by moving the clamps 40 away from their respective supports, thereby releasing the bight end portions. In order to form the beaded loop into a bracelet or necklace, the beaded loop is formed into a circle, as shown in FIG. 11, by bringing the bight end portions together, preferably by wrapping the beaded loop around one's wrist or neck. A fastener 56 is connected to one of the bight end portions, and is hooked onto the other bight end portion to complete the circle. The fastener 56 preferably has a resilient or spring-biased latch to permit ready hooking and unhooking of the fastener.

Figure 1:
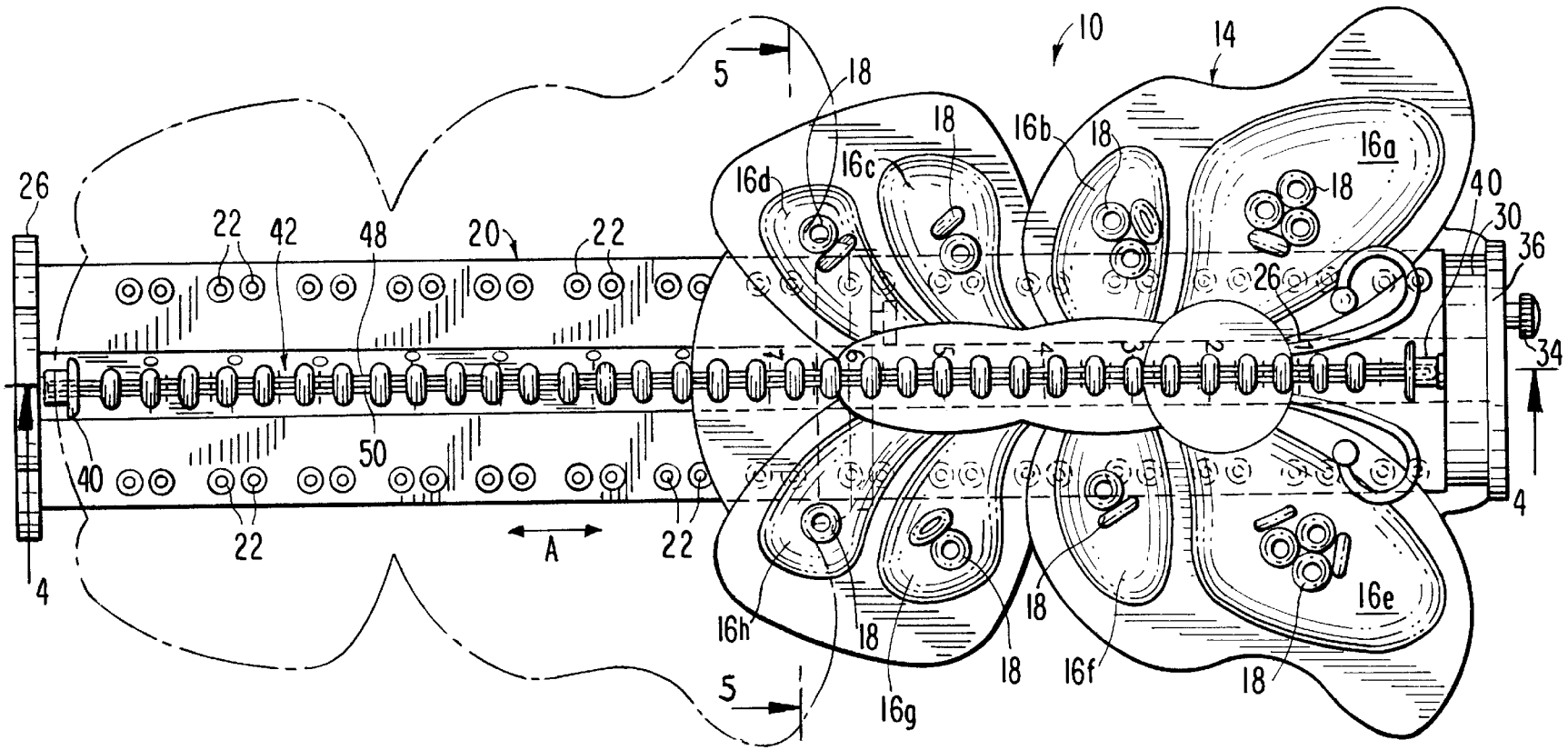
FIG. 1 is a top plan view of an arrangement according to this invention during the making of an ornament.

A necklace typically requires that the beaded loop be longer than for a bracelet. Whatever length is required, the length of the beaded loop is set in advance by the aforementioned scale 26 which depicts the length between the end faces of the supports 28, 32. The housing sections are positioned at the desired length. FIG. 1 depicts in solid lines the main section positioned at a near maximum distance away from the extension section, and also shows in phantom lines the minimum distance at which the sections are spaced apart. The main section is configured with a butterfly shape as seen in top plan view for aesthetic purposes; other shapes are possible.

It will be understood that each of the elements described above, or two or more together, also may find a useful application in other types of constructions differing from the types described above. For example, a motor may replace the hand crank.

While the invention has been illustrated and described as embodied in a beaded ornament and arrangement for and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

I Claim:

1. An arrangement for making an ornament, comprising:

a) a supporting structure having a pair of supports spaced apart along a longitudinal axis;

b) a closed loop of a twistable, shape-retaining material having a pair of bight end portions respectively mounted on the supports, and a pair of rail portions extending along the longitudinal axis between the supports;

c) a plurality of beads successively arranged along the rail portions, each bead having a passage through which both rail portions extend with clearance; and d) an actuator for jointly turning one of the supports and one of the bight end portions mounted thereon in a circumferential direction around the longitudinal axis, and for twisting the rail portions about each other to hold the beads in a fixed relation on the rail portions.

2. The arrangement of claim 1, wherein the supporting structure includes a pair of housing sections, one of the housing sections being mounted for movement along the longitudinal axis relative to the other of the housing sections.

3. The arrangement of claim 2, wherein said one housing section is adjustably received in said other housing section.

4. The arrangement of claim 2, wherein the other housing section has compartments for storing the beads.

5. The arrangement of claim 2, wherein the supporting structure includes a plurality of locks on the housing sections and successively arranged along the longitudinal axis, for locking the housing sections in a selected position relative to each other.

6. The arrangement of claim 5, wherein said one housing section has indicia arranged along the longitudinal axis, for visually indicating the selected position.

7. The arrangement of claim 1, wherein each support has a pair of arms bounding a slot in which a respective bight end portion is received, and a clamp for urging the arms towards each other into clamping engagement with the respective bight end portion.

8. The arrangement of claim 1, wherein the actuator includes a hand crank for manually turning said one support.

9. The arrangement of claim 1, wherein the material of the loop is a metallic wire.

10. The arrangement of claim 1; and further comprising a fastener for fastening the bight end portions together after the beads are held in the fixed relation on the rail portions.

11. A method of making an ornament, comprising the steps of:

a) spacing a pair of supports apart along a longitudinal axis;

b) respectively mounting a pair of bight end portions of a closed loop of a twistable, shape-retaining material on the supports;

c) successively arranging a plurality of beads along a pair of rail portions of the closed loop that extend along the longitudinal axis between the supports by threading both rail portions through a passage in each bead with clearance; and d) jointly turning one of the supports and one of the bight end portions mounted thereon in a circumferential direction around the longitudinal axis, and twisting the rail portions about each other to hold the beads in a fixed relation on the rail portions.

12. The method of claim 11; and further comprising the step of mounting the supports on respective housing sections movable relative to each other along the longitudinal axis.

13. The method of claim 12; and further comprising the step of storing the beads in compartments on one of the housing sections.

14. The method of claim 12; and further comprising the step of locking the housing sections in a selected position relative to each other before performing the turning step.

15. The method of claim 11, wherein the turning step is performed by manually turning a hand crank.

16. The method of claim 11; and further comprising the step of removing the closed loop from the supports after the turning step has been performed, the step of forming the closed loop into an annulus by bringing the bight end portions together, and the step of fastening the bight end portions together.

17. An ornament, comprising:

a) a closed loop of a twistable, shape-retaining material having a pair of bight end portions, and a pair of rail portions extending between the bight end portions, the rail portions being twisted about each other;

b) a plurality of beads successively arranged along the rail portions, each bead having a passage through which both rail portions extend with clearance, the beads being held in a fixed relation on the twisted rail portions; and c) a fastener for fastening the bight end portions together.

* * * * *